United States Patent [19]

Swengel, Jr.

[11] Patent Number: 4,552,423

[45] Date of Patent: Nov. 12, 1985

[54] SHUNTED ELECTRICAL CONNECTORS

[75] Inventor: Robert C. Swengel, Jr., York, Pa.

[73] Assignee: AMP Incorporated, Harrisburg, Pa.

[21] Appl. No.: 595,571

[22] Filed: Mar. 30, 1984

[51] Int. Cl.[4] ..... H01R 31/08

[52] U.S. Cl. ..... 339/19; 200/51.1; 339/143 R

[58] Field of Search ..... 339/19, 18 R, 18 B, 339/18 C, 18 P, 14 R, 143 R; 200/51.1

[56] References Cited

U.S. PATENT DOCUMENTS

| | | | |
|---|---|---|---|
| 4,274,691 | 6/1981 | Abernathy et al. | 339/19 |
| 4,371,226 | 2/1983 | Brancaleone | 339/143 R |
| 4,384,754 | 5/1983 | Douty et al. | 339/19 |

OTHER PUBLICATIONS

IBM Bulletin, Arnold et al., vol. 13, No. 6, p. 1628, 11-1970.

*Primary Examiner*—Neil Abrams

*Attorney, Agent, or Firm*—Robert W. J. Usher

[57] ABSTRACT

A programmable shunting strip stamped and formed from sheet metal comprising of web (12) from which a series of contact fingers (13) have been stamped to extend transversely of the web substantially in its plane. Selected contact fingers 13' can be bent to extend transversely of the plane of the web (12) and received in an electrical connector socket (25) to common selected terminals (32) in the socket (25).

3 Claims, 7 Drawing Figures

SHUNTED ELECTRICAL CONNECTORS

SHUNTED ELECTRICAL CONNECTORS

The invention relates to a shunted electrical connector socket and to a shunting strip for application to an electrical connector to shunt selected terminals thereof.

Shunted electrical connectors are known and there have been various proposals to shunt selected different terminals of a connector by using a programmable shunt.

In one proposal described in U.S. patent application Ser. No. 435,007 filed Oct. 18, 1982 now abandoned, a comb shaped shunting strip is proposed in which a series of teeth extend in coplanar relation from a bridge. Selected teeth can be broken away as desired and the shunt can be inserted into a connector socket cavity so that the remaining teeth engage and common preselected terminals in the connector cavity.

However, a disadvantage of the proposal is that, as a result of the teeth and bridge being coplanar, the bridge must be relatively narrow and must preferably, be received within the profile of the socket housing to avoid utilizing space in printed circuit board applications. Furthermore, removal of teeth significantly reduces the effective cross sectional size and mass of the shunt. Both these factors reduce the effectiveness of the shunt as a heat sink which limits to a low level, the currents that can be carried by the shunt.

In addition, breaking away selected teeth can be time consuming requiring special tooling and considerable manual dexterity if damage to adjacent teeth is to be avoided. Furthermore, once removed, the teeth cannot be replaced so that any reprogramming necessitated by a change of use a mistake cannot be undertaken.

It is an object of the inventor to avoid or ameliorate the above mentioned disadvantages.

According to one aspect of the invention there is provided an electrical connector socket comprising an insulating housing having first, front and second, rear ends, spaced apart wall portions extending between the ends defining between them a plug receiving cavity open at a plug receiving mouth at the first end, terminals extending cantilever spring fashion rearwardly from root ends adjacent a wall portion adjacent the mouth across the cavity away from the wall portion to free ends spaced from the wall portion adjacent the rear end so that insertion of the plug into the cavity deflects the terminals towards the wall portion, a programmable shunt secured to the housing adjacent the rear end, the shunt being stamped and formed from sheet metal and comprising a web portion from which a series of individual contact fingers have been stamped to lie adjacent the plane of the web at the same pitch as the terminals, preselected individual contact fingers of the series having been bent to project transversely from the plane of the web into the rear end of the cavity on a side of the terminals remote from the wall portion into engagement with free end portions of preselected terminals, thereby, to common the terminals when the plug is not received in the cavity.

The retention of all the contact fingers in the strip both enhances the heat sink capabilities of the shunt permitting much higher currents to be carried and enables reprogramming if necessary.

As the connector housing is usually rectangular the web will normally lie flush against a rear wall of the housing with the contact fingers projecting transversely of its plane into the plug receiving cavity.

According to another aspect of the invention there is provided a programmable shunting strip stamped and formed from sheet metal and comprising an elongate web from which contact fingers have been stamped to extend transversely of the web adjacent its plane, a series of contact legs extending from a longitudinal edge of the web in the same direction as the fingers, means being provided to locate the strip on a connector housing, with the web extending adjacent a wall thereof, individual, contact fingers being selectively deformable to project transversely of the plane of the web.

The shunt can therefore be manufactured as a continuous strip using inexpensive mass production techniques.

Examples of the invention will now be described with reference to the accompanying drawings in which.

Figure 1:
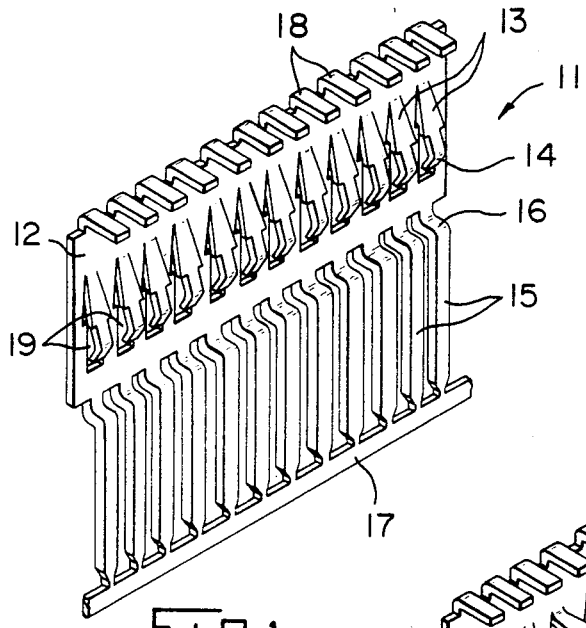
FIG. 1 is a isometric view of the programmable shunting strip.
Figure 2:
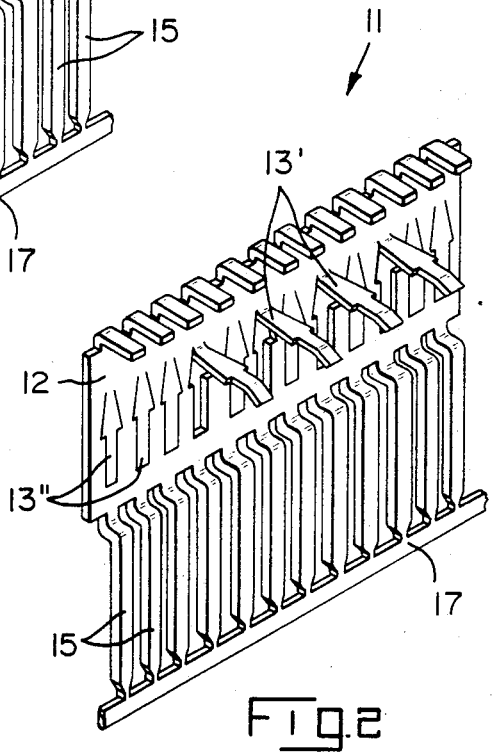
FIG. 2 is a similar view of the strip after programming.

As shown more clearly in FIGS. 1 and 2, the first example of programmable shunting strip 11 is stamped and formed from sheet metal and comprises an elongate web 12 from which a series of contact fingers 13 are stamped (FIG. 1) to extend transversely of the strip adjacent the plane of the strip with their free ends 14 extending proud of the strip surface. A series of spaced contact legs 15 extends from one longitudinal edge of the web, each leg being struck out of the plane of the web at a root end to define a shoulder 16. Prior to attachment to the connector, the free ends of the legs are joined by an elongate strip portion 17 to prevent damage to the legs from handling. A series of lugs 18 extend from the other longitudinal edge of the web perpendicular to the plane of the web. During manufacture, prior to forming the lugs and shoulders a perforated strip portion may be attached to the lugs for indexing purposes.

Prior to assembly of the shunting strip to a connector housing, selected contact fingers 13' are bent to extend transversely of the plane of the web and the remaining contact fingers 13" forcibly returned into the slots 19 produced by their stamping in which slots they are received in an interference fit as shown in FIG. 2. This maintains the remainder of the web in completely flat condition so that it occupies a minimum of printed circuit board space and has no projecting parts likely to produce a risk of inadvertent contact. The strip portion joining the legs may finally be removed and individual legs broken away as required by the particular application.

Figure 7:
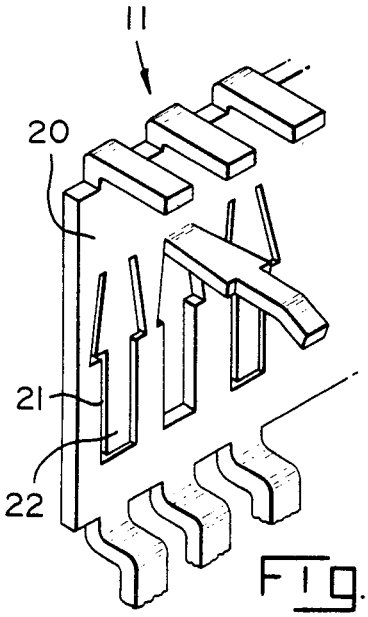
FIG. 7 is an enlarged fragmentary isometric view of an alternative programmable shunting strip.
Figure 3:
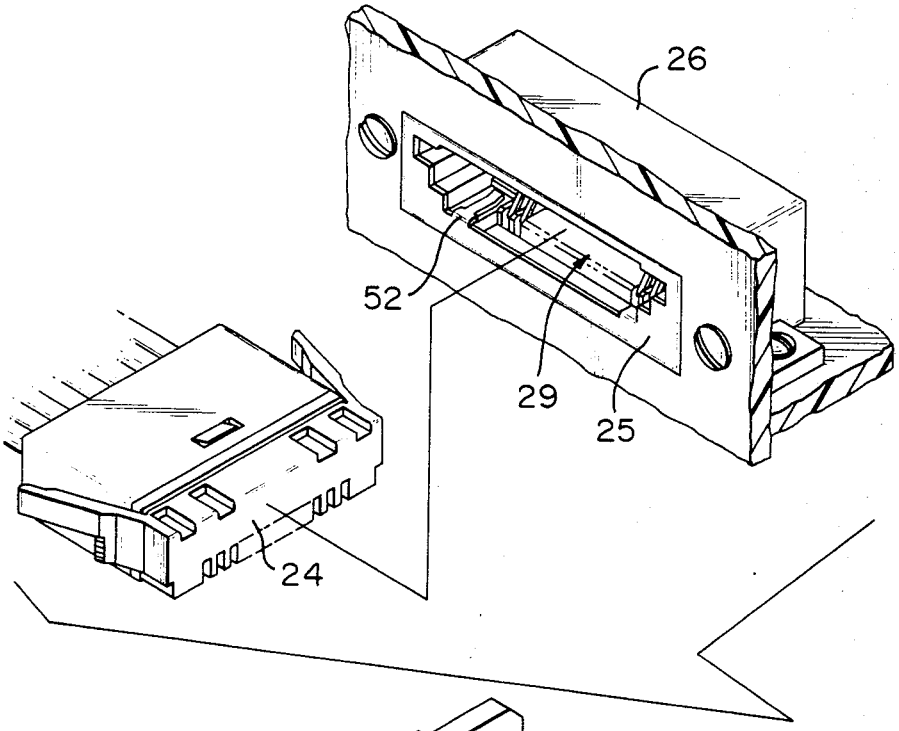
FIG. 3 is a isometric view of the socket connector and a suitable mating plug.
Figure 6:
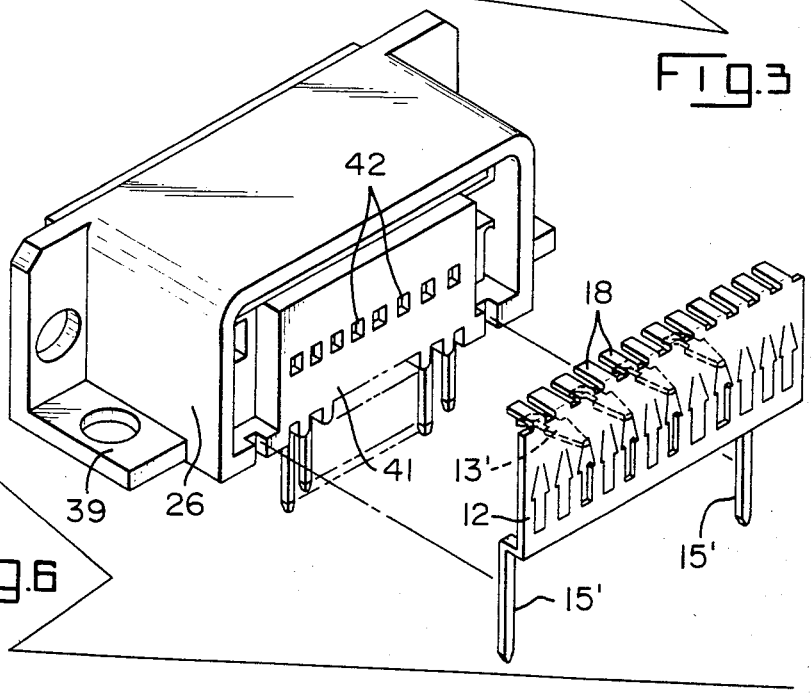
FIG. 6 is a rear isometric view of the connector housing.
Figure 4:
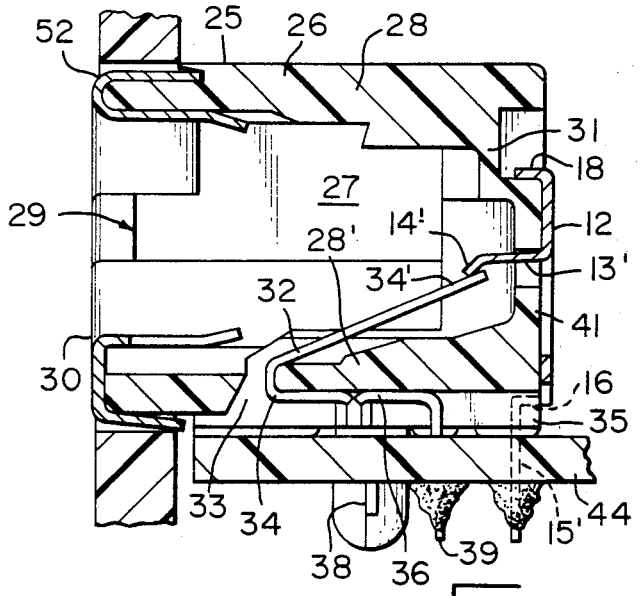
FIG. 4 is a cross sectional view of the socket connector with the programmed strip attached prior to insertion of a plug.
Figure 5:
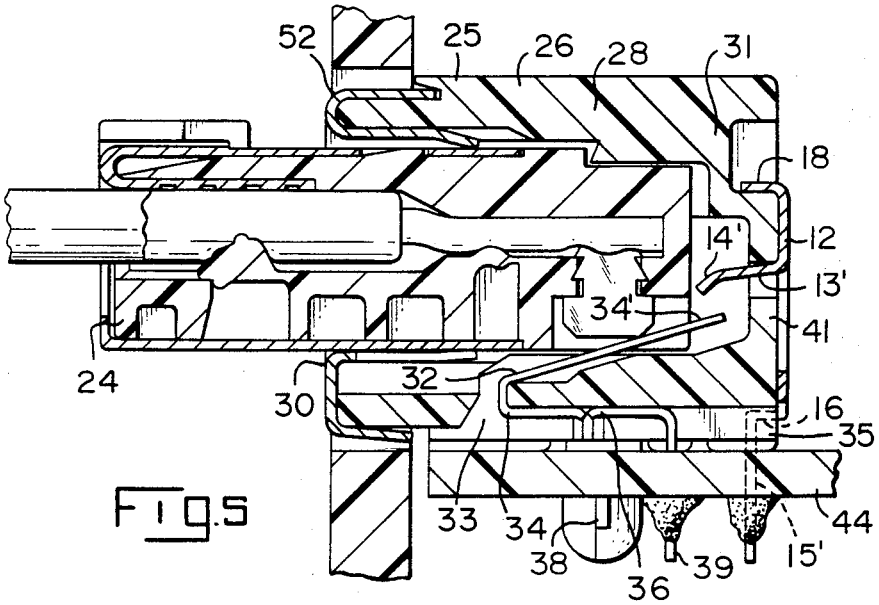
FIG. 5 is a cross sectional view of the socket connector after insertion of the plug.

In an alternative shunting strip shown in FIG. 7, portions of the web 20 are removed by stamping so that clearance 21 is left between longitudinal edges of contact legs 22 and the remainder of the web after stamping so that when the contact legs are pushed back into the plane of the web they are received in their slots as a free fit.

As shown in FIGS. 3–6, a shielded data link connector comprises an intermatable plug 24 and socket 25 both of which are generally similar to that described in the above-mentioned patent application with the addition of stamped and formed shield members 51 and 52 which form no part of the present invention.

The socket comprises a housing 26 moulded of plastics material. Opposed side, and top and base walls 27;28,28' extend between front and rear ends in spaced apart relation defining between them a plug receiving cavity 29 opening at a plug receiving mouth 30 at a front end. A rear wall 31 closes the rear end of the socket. A series of terminals 32 extend through an aperture 33, in the base wall in contilever spring fashion from root ends 34 adjacent the mouth rearwardly across the cavity away from the base wall to free ends 34' spaced from the base wall and adjacent the rear wall. The root ends 34 are secured in channels 36 formed in the outer surface of the base wall by spreading at 36 and extend perpendicularly out of the channels to provide posts for receipt in a printed circuit board. Mounting posts 38 and ears 39 extend from the base wall. A rectangular land 41 is provided on the outside surface of the rear wall and formed with individual contact finger receiving apertures 42 aligned with respective terminals.

As the plug forms no part of the present invention and is disclosed in the above-mentioned patent application the disclosure of which is incorporated herein by reference, it will not be further described.

In assembling the connector, the terminals are deflected towards the base wall (e.g. by insertion of a plug) and the programmed, shunting grip seated on the printed circuit board 44 by the lugs 18 and shoulders 16 located against upper and lower horizontal walls respectively of the land 41 and selected lugs 15' secured in depressions in a rearwardly extending skirt surrounding the land by heat deformation of the plastics material. On releasing the terminals, their free ends 34' resile into engagement into the free ends of the contact fingers. Inserting the plug into the socket deflects the terminals towards the base wall away from the contact fingers, as shown in FIG. 2, while establishing electrical connection with the plug contacts.

I claim:

1. An electrical connector socket comprising an insulating housing having first, front and second, rear ends, spaced apart wall portions extending between the ends and across the rear end defining between them a plug receiving cavity open at a plug receiving mouth at the first end, terminals extending cantilever spring fashion rearwardly from root ends adjacent one wall portion adjacent the mouth across the cavity away from the one wall portion to free ends spaced from the one wall portion adjacent the rear end so that insertion of the plug into the cavity deflects the terminals towards the one wall portion, a programmable shunt stamped and formed from sheet metal and comprising a web portion from which a series of individual contact fingers have been stamped to lie adjacent the plane of the web at the same pitch as terminals, the shunt being secured to the housing with the web adjacent and face-to-face with a wall portion, preselected individual contact fingers of the series having been bent to project transversely out from the plane of the web into the rear end of the cavity on a side of the terminals remote from the one wall portion into engagement with free end portions of preselected terminals thereby to common the terminals when the plug is not received in the cavity, the unselected contact fingers remaining adjacent the plane of the web.

2. An electrical connector according to claim 1 in which a series of contact legs extend from an edge of the web for receipt in a printed circuit board.

3. An electrical connector according to claim 1 in which the contact fingers extend in parallel planes, the preselected fingers lying in the same planes as respective terminals and being joined to the web at a location on a side of the terminals remote from the one wall portion.

* * * * *